US008936497B2

(12) United States Patent
Brodsky et al.

(10) Patent No.: US 8,936,497 B2
(45) Date of Patent: Jan. 20, 2015

(54) CONNECTOR WITH A ROTATABLY COUPLED CAM SHAFT HAVING A CONNECT-ASSIST ELEMENT

(71) Applicant: International Business Machines Corporation, Armonk, NY (US)

(72) Inventors: William L. Brodsky, Binghamton, NY (US); Charles C. Gange, Rhinebeck, NY (US); Robert R. Genest, Poughkeepsie, NY (US); Michael T. Peets, Staatsburg, NY (US)

(73) Assignee: International Business Machines Corporation, Armonk, NY (US)

( * ) Notice: Subject to any disclaimer, the term of this patent is extended or adjusted under 35 U.S.C. 154(b) by 142 days.

(21) Appl. No.: 13/777,340

(22) Filed: Feb. 26, 2013

(65) Prior Publication Data

US 2014/0242829 A1 Aug. 28, 2014

(51) Int. Cl.
*H01R 13/62* (2006.01)

(52) U.S. Cl.
CPC ..... *H01R 13/62* (2013.01)
USPC ..... 439/752; 439/314

(58) Field of Classification Search
None
See application file for complete search history.

(56) References Cited

U.S. PATENT DOCUMENTS

| | | | | |
|---|---|---|---|---|
| 5,662,488 | A * | 9/1997 | Alden | 439/314 |
| 5,695,365 | A * | 12/1997 | Kennedy et al. | 439/638 |
| 6,226,068 | B1 * | 5/2001 | Arcykiewicz et al. | 439/314 |
| 6,280,227 | B1 | 8/2001 | Terada et al. | |
| 6,561,841 | B2 * | 5/2003 | Norwood et al. | 439/489 |
| 6,913,475 | B2 * | 7/2005 | Hsu | 439/160 |
| 7,014,490 | B1 | 3/2006 | Morikawa et al. | |
| 7,241,188 | B2 * | 7/2007 | Lin et al. | 439/838 |
| 7,354,292 | B1 | 4/2008 | Lloyd et al. | |
| 7,497,723 | B2 | 3/2009 | Brassell et al. | |
| 7,699,642 | B2 | 4/2010 | Yamashita et al. | |
| 7,854,618 | B2 | 12/2010 | Liu et al. | |
| 8,043,128 | B2 * | 10/2011 | Ando et al. | 439/752 |
| RE42,926 | E | 11/2011 | Norwood et al. | |
| 8,075,332 | B2 | 12/2011 | Amidon | |
| 8,100,709 | B2 | 1/2012 | Zhang | |
| 2004/0033711 | A1 * | 2/2004 | Loveless et al. | 439/314 |
| 2009/0246999 | A1 | 10/2009 | Crofoot et al. | |

* cited by examiner

*Primary Examiner* — Chandrika Prasad
(74) *Attorney, Agent, or Firm* — Margaret A. McNamara, Esq.; Kevin P. Radigan, Esq.; Heslin Rothenberg Farley & Mesiti P.C.

(57) ABSTRACT

A connector apparatus is provided which includes a connector and a mechanical connect-assist mechanism associated, at least in part, with the connector. The connector is configured to operatively plug into a socket structure, and the mechanical connect-assist mechanism includes a cam shaft rotatably coupled to the connector and a connect-assist element projecting from the rotatable cam shaft. The connect-assist element is configured to engage at least one element-receiving opening associated with the socket structure with insertion of the connector within the socket structure. Rotating of the rotatable cam shaft moves the connect-assist element within the at least one element-receiving opening to facilitate secure seating and retention of the connector within the socket structure. In one embodiment, the connect-assist element is a rod extending transverse through the rotatable cam shaft, and configured to engage first and second element-receiving openings associated with the socket structure on opposite sides of the connector.

20 Claims, 10 Drawing Sheets

CONNECTOR WITH A ROTATABLY COUPLED CAM SHAFT HAVING A CONNECT-ASSIST ELEMENT

BACKGROUND

Plugable-style connectors are often used in association with or within electronic systems, such as within an electronics rack, or between racks within a data center. These connectors facilitate electrical and/or communication coupling between the different components of an electronic system, electronics rack or data center. Such connectors, which are generally referred to as cable connectors, facilitate connection of one or more cables to one or more sockets within the electronic system, electronics rack or data center. For instance, cable connectors are widely used to make connections to routers or servers within an electronics rack, where space is often at a premium. In addition to there being little extra space, cable connectors of this type may have the tendency to separate or become partially disconnected from the socket component to which they are connected, particularly if one of more of the associated cables are inadvertently moved or pulled.

In view of this, enhancements to cable connectors are believed desirable, particularly for use within or in association with electronic systems.

BRIEF SUMMARY

The shortcomings of the prior art are addressed and additional advantages are provided through the provision, in one aspect, of a connector apparatus. The connector apparatus includes: a connector configured to operatively plug into a socket structure; and a mechanical connect-assist mechanism associated, at least in part, with the connector. The mechanical connect-assist mechanism includes a cam shaft rotatably coupled to the connector, and a connect-assist element projecting from the rotatable cam shaft. The connect-assist element is configured to engage at least one element-receiving opening associated with the socket structure with insertion of the connector within the socket structure. Rotation of the rotatable cam shaft moves the connect-assist element within the at least one element-receiving opening to facilitate secure seating and retention of the connector within the socket structure.

In another aspect, an electronic assembly is provided which includes an electronic system and a connector apparatus. The electronic system includes a socket structure, and the connector apparatus includes a connector and a mechanical connect-assist mechanism. The connector is configured to operatively plug into the socket structure of the electronic system, and the mechanical connect-assist mechanism is associated with, at least in part, the connector. The mechanical connect-assist mechanism includes: a cam shaft rotatably coupled to the connector; and a connect-assist element projecting from the rotatable cam shaft, wherein the connect-assist element is configured to engage at least one element-receiving opening associated with the socket structure with insertion of the connector within the socket structure, and rotating of the rotatable cam shaft moves the connect-assist element within the at least one element-receiving opening to facilitate secure seating and retention of the connector within the socket structure.

In a further aspect, a method of fabricating a connector apparatus is provided. The method includes: providing a connector coupled to operatively plug into a socket structure; and associating a mechanical connect-assist mechanism, at least in part, with the connector, the mechanical connect-assist mechanism including: a cam shaft rotatably coupled to the connector; and a connect-assist element projecting from the rotatable cam shaft, wherein the connect-assist element is configured to engage at least one element-receiving opening associated with the socket structure with insertion of the connector within the socket structure, and rotating of the rotatable cam shaft moves the connect-assist element within the at least one element-receiving opening to facilitate secure seating and retention of the connector within the socket structure.

Additional features and advantages are realized through the techniques of the present invention. Other embodiments and aspects of the invention are described in detail herein and are considered a part of the claimed invention.

BRIEF DESCRIPTION OF THE SEVERAL VIEWS OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

As used herein, the terms "electronics rack", and "rack unit" are used interchangeably, and unless otherwise specified include any housing, frame, rack, compartment, blade server system, etc., having one or more heat-generating components of a computer system or electronic system, and may be, for example, a stand-alone computer processor having high, mid or low end processing capability. In one embodiment, an electronics rack may comprise a portion of an electronic system, a single electronic system or multiple electronic systems, for example, in one or more sub-housings, blades, books, drawers, nodes, compartments, etc., having one or more heat-generating electronic components disposed therein. An electronic system(s) within an electronics rack may be movable or fixed relative to the electronics rack, with rack-mounted electronic drawers and blades of a blade center system being two examples of electronic systems (or subsystems) of an electronics rack to be cooled. As one specific example, the electronics rack may be an IT Enterprise Computer System, implemented, for example, employing System z server units, or System p server units, offered by International Business Machines Corporation. System z and System p are trademarks of International Business Machines Corporation, of Armonk, N.Y.

Further, as used herein, "socket structure" comprises any socket or connector of, for instance, an electronic system, configured to accommodate one or more connectors or connector apparatuses, such as disclosed herein. The socket structure may be a discrete structure, or may include (for instance) a portion of a housing within which the socket resides. As used herein, a "connector" refers to any connect structure or assembly characterized as disclosed herein, with a cable connector or multi-cable connector being examples of a connector which may be part of a connector apparatus, in accordance with one or more aspects of the present invention. As used herein, a connector may be any of a variety of connectors, such as an electrical, electronic, or communication connector, etc.

Reference is made below to the drawings, which are not drawn to scale for ease of understanding, wherein the same reference numbers used throughout different figures designate the same or similar components.

Figure 1:
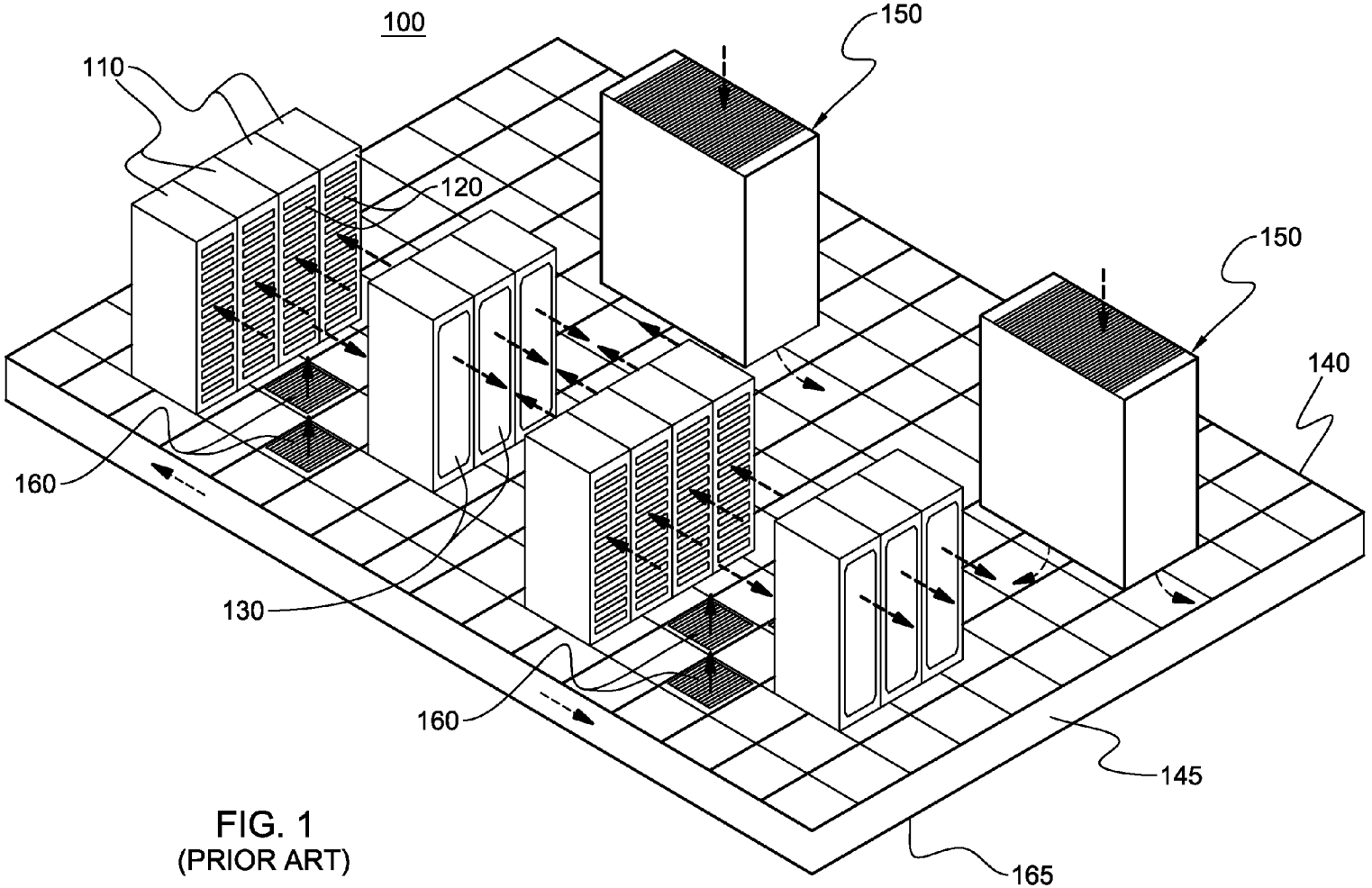
FIG. 1 (PRIOR ART)
FIG. 1 depicts one embodiment of a conventional raised floor layout of a data center containing multiple electronics racks.

FIG. 1 depicts a raised floor layout of a data center 100 typical in the prior art, wherein multiple electronics racks 110 are disposed in one or more rows. A data center such as depicted in FIG. 1 may house several hundred, or even several thousand microprocessors. In the arrangement illustrated, chilled air enters the computer room via perforated floor tiles 160 from a supply air plenum 145 defined between the raised floor 140 and a base or sub-floor 165 of the room. Cooled air is taken in through louvered or screened doors at the front (i.e., air inlet sides 120) of the electronics racks and expelled through the back (i.e., air outlet sides 130) of the electronics racks. Each electronics rack 110 may have one or more air moving devices (e.g., fans or blowers) to provide forced inlet-to-outlet airflow to cool the electronic components within the drawer(s) of the rack. The supply air plenum 145 provides conditioned and cooled air to the air-inlet sides of the electronics racks via perforated floor tiles 160 disposed in a "cold" aisle of the computer installation. The conditioned and cooled air is supplied to plenum 145 by one or more air conditioning units 150, also disposed within the data center 100. Room air is taken into each air conditioning unit 150 near an upper portion thereof. This room air comprises in part exhausted air from the "hot" aisles of the computer installation defined by opposing air outlet sides 130 of the electronics racks 110. Each electronics rack typically contains one or more electronic systems which utilize interconnecting cables with associated cable connectors.

Figure 2:
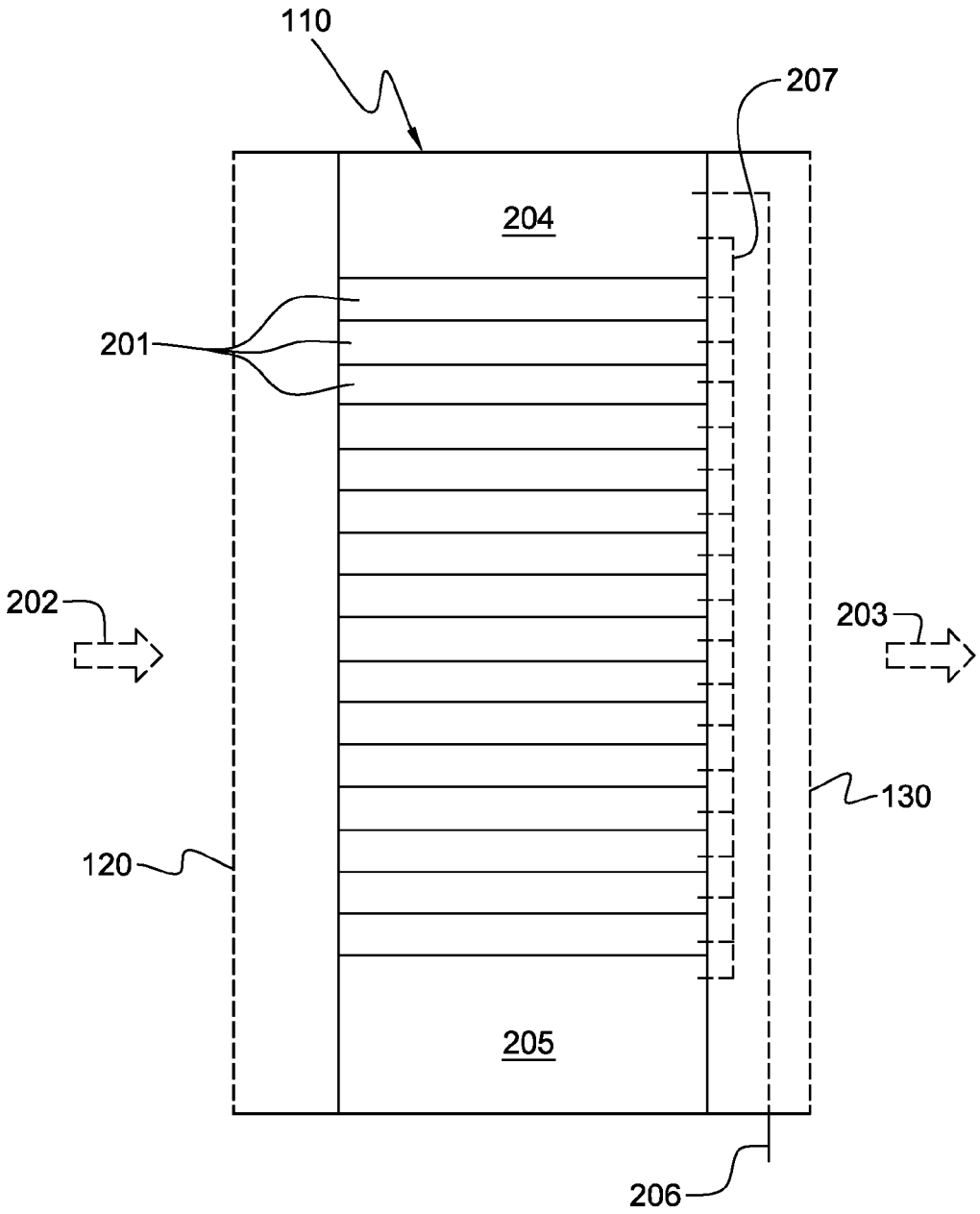
FIG. 2 is a cross-sectional elevational view of one embodiment of an electronics rack comprising, in one embodiment, one or more electronic systems having socket structures which accommodate one or more connector apparatuses, in accordance with one or more aspects of the present invention.

FIG. 2 is an elevational representation of one embodiment of an electronics rack 110. In the embodiment shown, electronics rack 110 includes a plurality of electronic systems 201, which (in the embodiment illustrated) may be air-cooled by cool air 202 ingressing via louvered air inlet door 210, and exhausting out louvered air outlet door 211 as hot air 203. Electronics rack 110 also includes (in one embodiment) at least one bulk power assembly 204. One or more electronic systems 201 include, in one example, one or more processors, associated memory, input/output devices or adapters and disk storage devices. Also illustrated in FIG. 2 is an I/O and disk expansion subsystem 205, which includes, in one detailed example, PCIe card slots and disk drivers for one or more electronic systems of the electronics rack. Note that I/O and disk expansion subsystem 205 could be disposed anywhere within electronics rack 110, with the positioning shown in FIG. 2 being provided as one example only. For example, the I/O and disk expansion subsystem 205 could alternatively be disposed in the middle of the electronics rack, if desired.

In one rack example, a three-phase AC source feeds power via an AC power cord 206 to bulk power assembly 204, which transforms the supplied AC power to an appropriate DC power level for output via distribution cables 207 to the plurality of electronic systems 201. AC power cord 206 supplies, in one example, three phase electrical power. The number and type of electronic systems installed in the electronics rack are variable and depend on customer requirements for a particular system.

Figure 3:
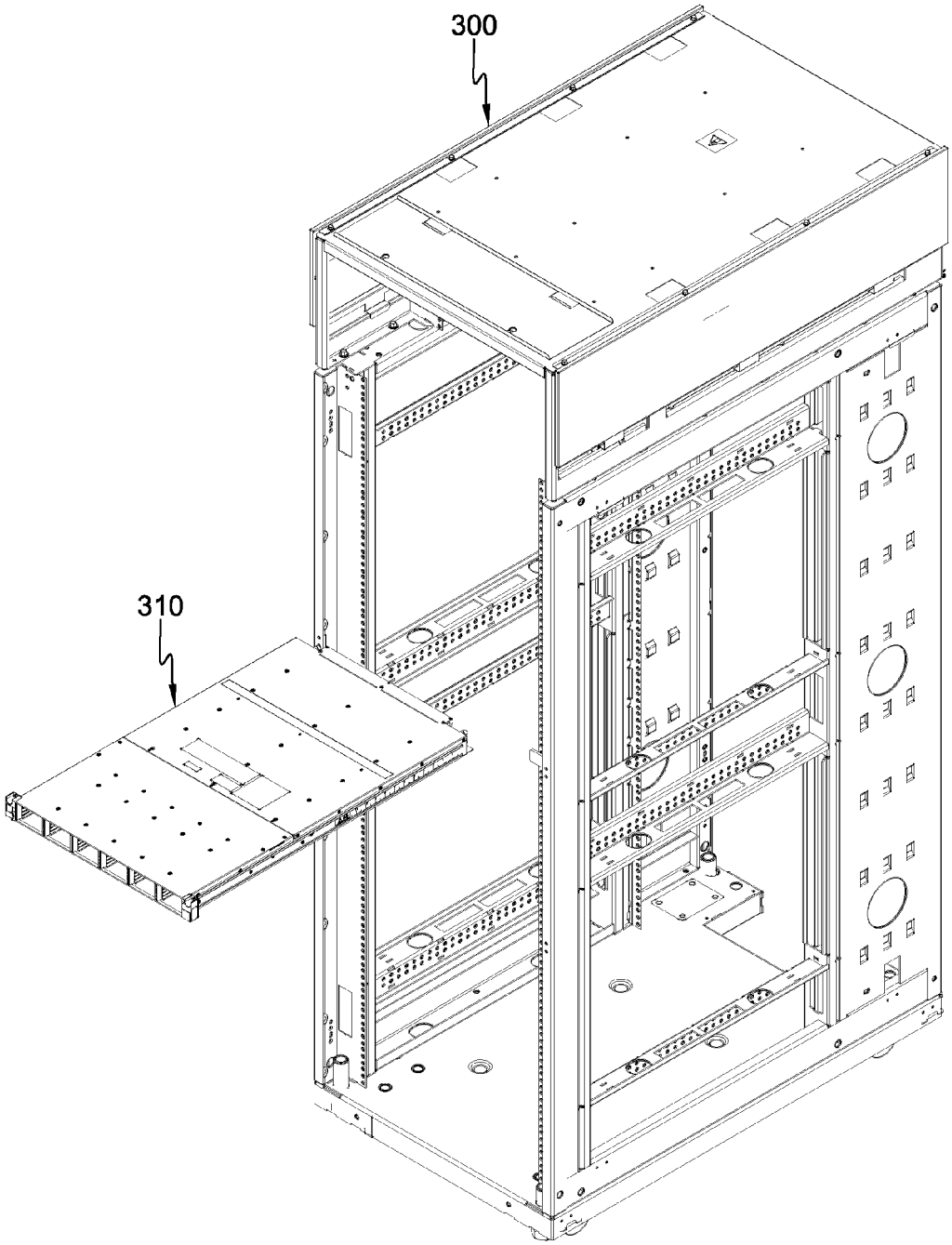
FIG. 3 depicts one embodiment of a rack frame and an electronic system comprising a housing including, at least in part, one or more socket structures which accommodate one or more connector apparatuses, in accordance with one or more aspects of the present invention.

As illustrated in FIG. 3, in one embodiment, an electronic assembly may comprise a rack frame 300, which accommodates one or more electronic systems, with one electronic subsystem 310 being illustrated by way of example. Electronic system 310 comprises an enclosure 311 configured to accommodate, in one example, a plurality of field-replaceable units, which slidably dock within respective field-replaceable unit (FRU)-receiving slots at one end of enclosure 311. Within rack frame 300, for instance, between multiple electronic systems 310, one or more cables, such as one or more electrical, electronic, or communication cables, may need to be connected. Dedicated socket structures may be provided for cable connectors to be operatively attached. The socket structures may facilitate coupling to, for instance, a mid-plane or back-plane of the electronic system to which connection is being made. Depending upon the implementation, cable connectors may be employed to facilitate connection to or between routers, servers, input/output devices, adapters, etc., within an electronics rack or between electronics racks of a data center. Oftentimes, there is little extra space within or around the socket structures configured to accommodate the cable connectors. Depending upon the implementation, it may be difficult for an operator to confirm docking or seating of a cable connector within a respective socket.

Disclosed herein is a connector apparatus which compensates for limited access by providing, in one aspect, a mechanical connect-assist mechanism that facilitates mechanical plugging of the connector within the respective socket structure, and which facilitates retaining of a connector in seated position within the socket structure, and that provides positive feedback features which allow an operator to readily verify that a connector is in seated position within the socket structure. Additionally, cable support features may be integrated within the connector apparatus.

Generally stated, disclosed herein, in one embodiment, is a connector apparatus which includes a connector configured to operatively plug into a socket structure, and a mechanical connect-assist mechanism associated, at least in part, with the connector. The mechanical connect-assist mechanism includes a cam shaft rotatably coupled to the connector, and a connect-assist element projecting from the rotatable cam shaft. The connect-assist element is configured to engage at least one element-receiving opening associated with the socket structure with insertion of the connector within the socket structure to facilitate, for instance, caming of the connector into the socket structure. In particular, rotating of the rotatable cam shaft moves the connect-assist element within the at least one element-receiving opening to facilitate secure seating and retention of the connector within the socket structure.

In certain aspects, the connect-assist element may extend through the rotatable cam shaft, and be sized and configured to engage a first element-receiving opening associated with the socket structure, and a second element-receiving opening associated with the socket structure, wherein the first and second element-receiving openings are disposed on opposite sides of the connector as the connector is inserted into the socket structure. With insertion of the connector into the socket structure, rotating of the rotatable cam shaft moves the connect-assist element within the first element-receiving opening and the second element-receiving opening, and the first element-receiving opening and the second element-receiving opening are configured so that movement of the connect-assist element therein facilitates drawing the connector into a seated position within the socket structure and retaining the connector in the seated position within the socket structure. By way of example, the connect-assist element may be a rod extending through the rotatable cam shaft, for instance, transverse to the rotatable cam shaft. In one implementation, the first element-receiving opening and the second element-receiving opening each extend at an angle to an axis of insertion of the connector into the socket structure, and are mirror image openings within the socket structure or associated housing of the socket structure.

As enhancements, the mechanical connect-assist mechanism may include one or more visual indicators of connection status, such as a visual indicator which indicates with insertion of the connector into the socket structure and rotating of the rotatable cam shaft whether the connector is unseated or the connector is seated within the socket structure.

Additionally, the mechanical connect-assist mechanism may further include a spring engaging the rotatable cam shaft with a detente or notch in the spring configured to be engaged by a cam lobe associated with the rotatable cam shaft. The cam lobe engages, at least in part, the detente, with seating of the connector within the socket structure to provide tactile feedback of connector seating within the socket structure to an operator. This cam lobe may be a first cam lobe associated with the rotatable cam structure, and the mechanical connect-assist mechanism may further include a second cam lobe associated with the rotatable cam shaft, wherein the second came lobe engages the detente with connector unseating from the socket structure to provide an operator with tactile feedback of unseating of a previously seated connector. Upon the second cam lobe engaging the detente, the connect-assist element has moved to an unseated position relative to the element-receiving opening associated with the socket structure. This tactile feedback of connector seating or connector unseating facilitates operator plugging or unplugging of the connector into the socket structure where space is limited and, for instance, a sight-line to the connector and/or socket structure may be impaired or even blocked.

By way of example, the connector may be a cable connector that is attached to one or more cables for use, for instance, within an electronic system or between electronic systems. In such a case, the socket structure may be associated with a housing which may include one or more electronic components of the electronic system. The connector may further comprise an enclosure which, in one embodiment, includes tapered connect-supports on one or more outer surfaces thereof which are configured to engage one or more surfaces of the socket structure (or housing associated with the socket structure) with seating of the connector within the socket structure, to facilitate retention of the connector in seated position within the socket structure and support of the one or more cables attached to the cable connector.

As a further enhancement, the one or more surfaces associated with the socket structure engaged by the tapered connector-supports of the connector enclosure may itself or themselves include tapered supports sized and configured to, for instance, engage or interlock with the tapered connector-supports of the connector enclosure with seating of the connector within the socket structure to further facilitate retention of the connector in seated position within the socket structure, and support the cable(s) to which the cable connector is attached.

As described herein, the connector apparatus disclosed advantageously includes a mechanical connect-assist or plug mechanism which facilitates caming of the connector into and out of operative engagement with a socket structure, and which provides positive feedback to ensure that the connector is fully seated. In addition, the mechanical connect-assist mechanism and associated socket structure include built-in supports that, for instance, overcome the cable weight, to facilitate preventing a seated connector from becoming unseated. In the connector apparatus disclosed, the space available to control the cables and/or cable connectors may be very limited. For instance, side-to-side symmetric multiprocessing (SMP) cable connectors are often closely packed, and above the connectors can be an overhanging input/output adapter cage, and below, another node (or cage), and to the front of the structure are the cable bundles that are attached to the cable connectors. Therefore, there is limited space to add hardware around or in front of the socket structures or connector assemblies. Thus, the connector apparatuses disclosed herein advantageously provide a compact design which provides, in part, visual verification, as well as tactile feedback, that a cable connector is in seated position within a respective socket structure.

To restate, the connector apparatus, and in particular, the mechanical connect-assist mechanism disclosed herein advantageously facilitates self-aligning of the connector to the socket structure or associated housing (such as an input/output cage), provides mechanical-assist or advantage in plugging or unplugging of the connector into the socket structure, allows blind or limited visibility seating or unseating of the connector relative to the socket structure, provides tactile response (such as a clicking or vibration) with a change of state, for instance, between unseated (unlatched) and seated (latched) positions. Still further, visual verification is provided to a technician during insertion of the connector into the socket structure of the connector's present state relative to the socket structure, that is, seated or unseated.

Figure 4:
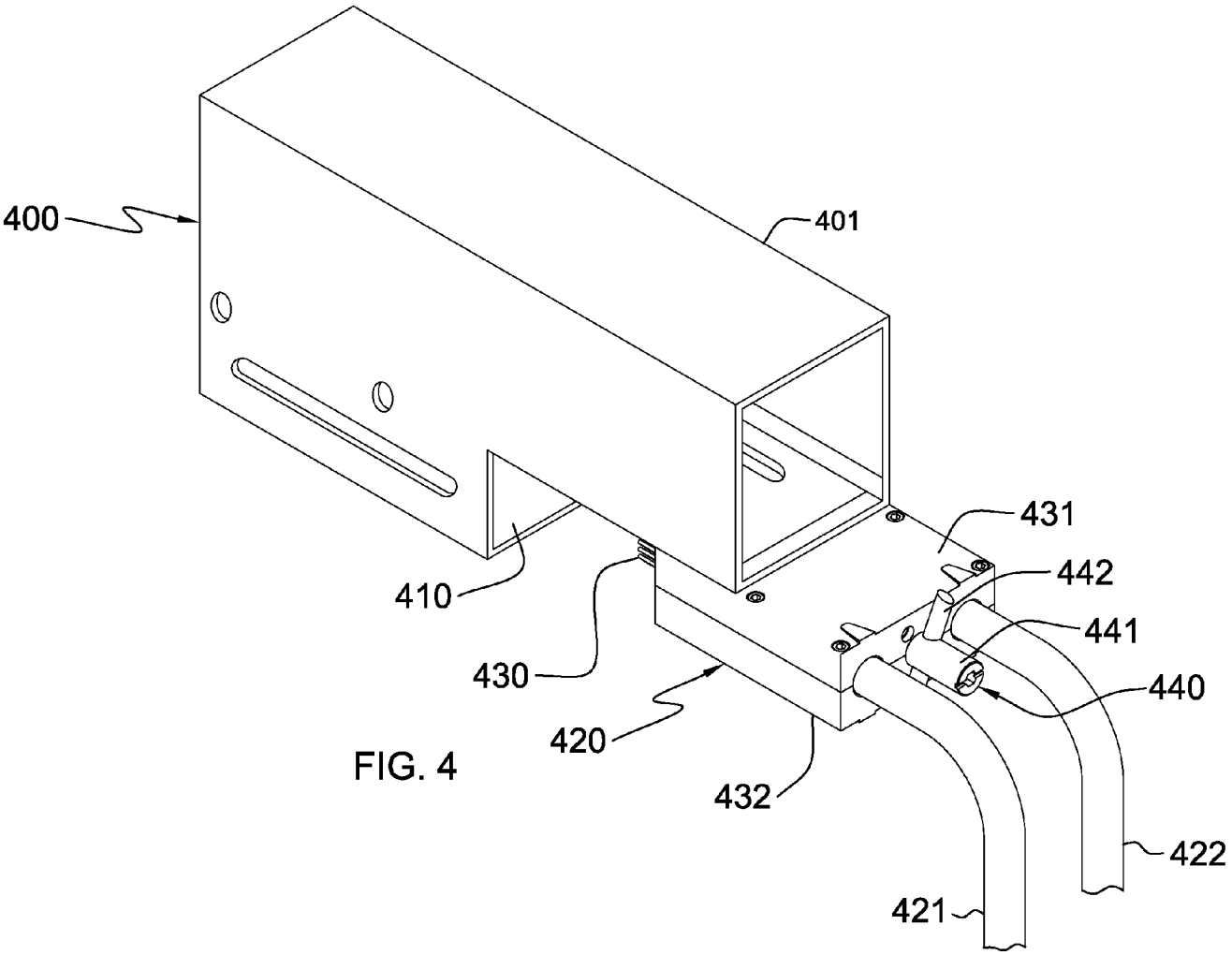
FIG. 4 is a partial isometric view of one embodiment of an electronic assembly which includes a housing of or associated with an electronic system such as depicted in FIGS. 2 & 3, and a connector apparatus comprising a cable connector and a mechanical connect-assist mechanism, in accordance with one or more aspects of the present invention.

FIG. 4 depicts, by way of example, one embodiment of an electronic assembly, generally denoted 400, which includes a housing or cage 401. By way of specific example, housing 401 may be configured for insertion of one or more devices, such as one or more input/output adapters, and reside within an electronic system and/or electronics rack such as described above in connection with FIGS. 2 & 3. Electronic assembly 400 includes, again by way of example only, a socket structure 410 defined within housing 401 which receives a connector 420 that facilitates electrical, optical, electronic, and/or communication connection, etc., to or from the electronic system. In this embodiment, connector 420 is a cable connector, and in particular, a multi-cable connector, which is shown to facilitate connection of a first cable 421 and a second cable 422 to socket structure 410. Connector 420 includes an upper enclosure (or housing) 431 and a lower enclosure (or housing) 432 which attach together to define the connector enclosure. In one embodiment, connector 420 includes a plurality of connection elements 430, which are sized and configured to operatively couple to corresponding connection structures (not shown) within socket structure 410.

Also illustrated in FIG. 4, is one embodiment of a mechanical connect-assist mechanism 440, in accordance with one or more aspects of the present invention. This mechanical connect-assist mechanism is shown to include a cam shaft 441 rotatably coupled to connector 420, and a connect-assist element 442 which projects from rotatable cam shaft 441. The connector 420 and mechanical connect-assist mechanism 440 embodiment of FIG. 4 are depicted in greater detail in FIGS. 5A & 5B.

Figure 5A:
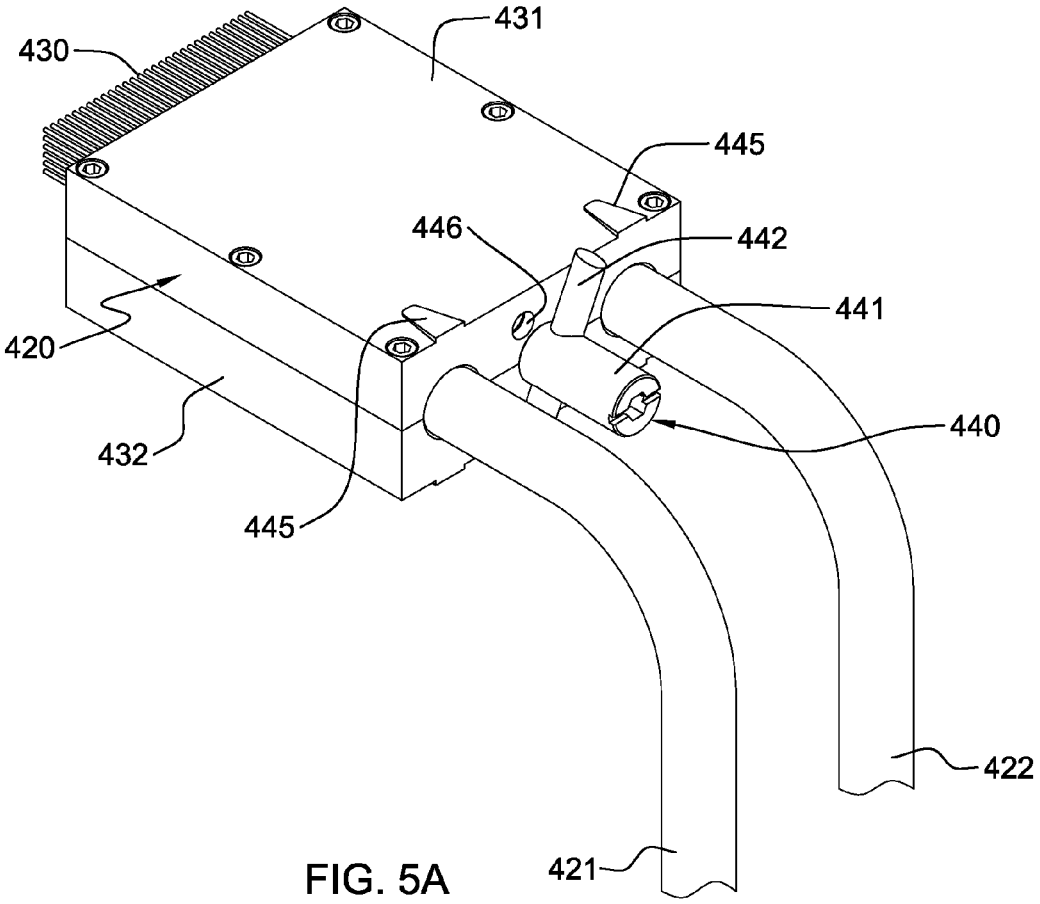
FIG. 5A is an enlarged depiction of the connector apparatus of FIG. 4, in accordance with one or more aspects of the present invention.
Figure 5B:
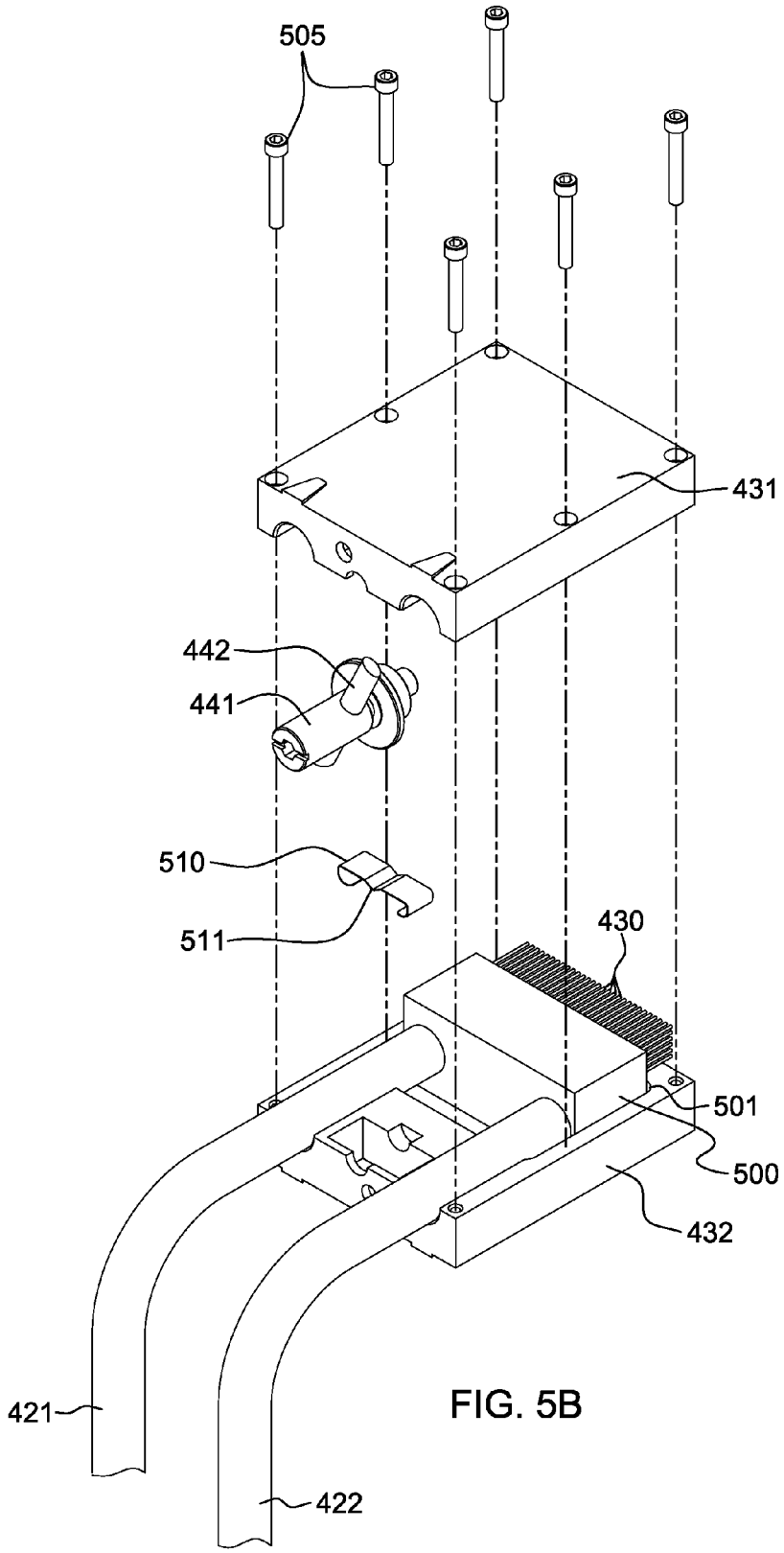
FIG. 5B is a partially exploded view of the connector apparatus of FIG. 5A, in accordance with one or more aspects of the present invention.

Referring collectively to FIGS. 5A & 5B, connector 420 is shown to include, for instance, a connection assembly 500 disposed, in part, within an appropriately sized opening 501 in lower enclosure 432. The plurality of connection elements 430 extend from connection assembly 500 for facilitating operative connection to corresponding connection structures of the socket structure (see FIG. 4). Connection assembly 500 may be any of a variety of conventional connection assemblies, including pins, cards, contacts, etc., designed to interface the one or more cables 421, 422 to the socket structure.

The mechanical connect-assist mechanism 440 is shown to include the rotatable cam shaft 441 and connect-assist element 442 which, in one embodiment, is a rod which extends through the rotatable cam shaft 441, for example, transverse to the rotatable cam shaft 441. The rotatable cam shaft resides (in this example) at the interface of the upper enclosure 431 and lower enclosure 432, and the connect-assist element includes (in the depicted embodiment) a spring 510 with a detente (or notch, relief, etc.) 511 disposed herein. The rotatable cam shaft 441, in one embodiment, rests on or engages spring 510 within the connector. As illustrated, the rotatable cam shaft and connect-assist element are exposed outside of the connector enclosure.

A plurality of screws or bolts 505 may be used to secure the connector apparatus together, that is, to secure the upper enclosure 431 and lower enclosure 432 in the manner illustrated. As described further below, tapered connector-supports 445 may be provided in one or more surfaces of the connector enclosure to facilitate, for instance, secure retention of the connector in a seated position within the socket structure, and in so doing, relieve stress on the connector due to gravity from the one or more cables 421, 422 attached to the cable connector.

FIGS. 6A-6D illustrate, in part, operation of the mechanical connect-assist mechanism 440 of FIGS. 4-5B.

Figure 6A:
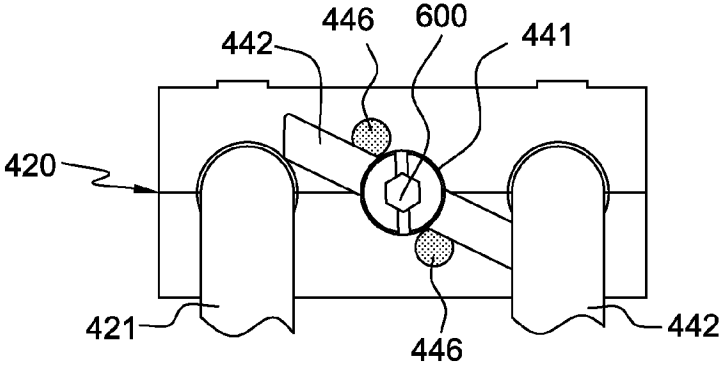
FIG. 6A is an elevational depiction of the connector apparatus of FIGS. 4-5B, depicting the mechanical connect-assist mechanism in unseated position, in accordance with one or more aspects of the present invention.

Referring to FIG. 6A, connector 420 is illustrated (in the present example) as being a multi-cable 421, 422 connector. The mechanical connect-assist mechanism 440 is shown in elevational view to include rotatable cam shaft 441 and connect-assist element 442, which in this example, is a rod which extends transverse through the rotatable cam shaft 441. A hexagonal-shaped opening 600 is provided in the end of rotatable cam shaft 441, into which a technician may insert a hex tool in order to facilitate rotation of the rotatable cam shaft, and thus movement of the connector 420 between unseated to seated positions within the socket structure. In this embodiment, status indicator openings 446 are provided in the connector enclosure, and the mechanical connect-assist mechanism 440 includes (in one example) different colored regions on the rotatable cam shaft portion disposed within connector 420, wherein different colored regions appear within openings 446 depending upon whether connector 420 is unseated (as illustrated in FIG. 6A) or seated (as illustrated in FIG. 6C). In this example, the different regions are differently colored regions, such as grey regions (see FIG. 6A) and white regions (see FIG. 6C), which provide visual indication to an operator or technician whether the mechanical connect-assist mechanism is fully seated or latched within the socket structure.

Figure 6B:
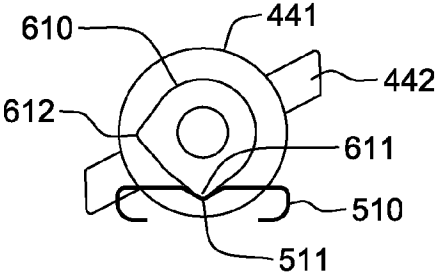
FIG. 6B is a 180° view of one embodiment of the mechanical connect-assist mechanism of FIG. 6A, showing the rotatable cam shaft, connect assist element, cam lobe, and spring with detente, which cooperate with rotation of the rotatable cam shaft to provide tactile feedback of seating or unseating of the connector, with the mechanical connect-assist mechanism shown in the unseated position, in accordance with one or more aspects of the present invention.
Figure 6C:
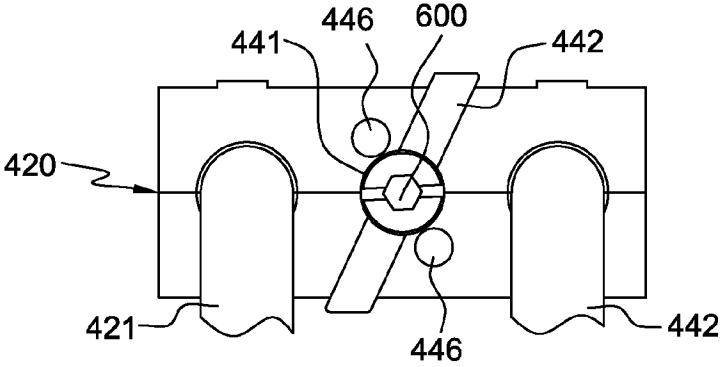
FIG. 6C is an elevational view of the connector apparatus of FIGS. 4-5B, depicting the mechanical connect-assist mechanism in seated position, in accordance with one or more aspects of the present invention.
Figure 6D:
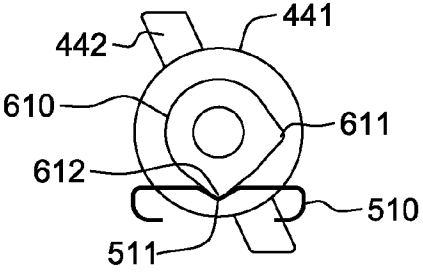
FIG. 6D is a 180° view of the mechanical-assist mechanism of FIGS. 6A-6C, showing cam lobe engagement of the detente in the spring for seated coupling of the connector to the socket structure, in accordance with one or more aspects of the present invention.

FIGS. 6B & 6D depict one embodiment of the rotatable cam shaft and connect-assist element of the mechanical connect-assist mechanism, shown positioned as illustrated in FIGS. 6A & 6C, respectively, but from a reverse (or 180°) view, and with the connector and cabling removed.

In FIG. 6B, the rotatable cam shaft 441 is shown to engage spring 510 with detente 511, which is engaged by a first cam lobe 611 formed in a portion 610 of the rotatable cam shaft 441. In this position, with first cam lobe 611 is disposed within detente 511, the mechanical connect-assist mechanism is in fully unseated position.

FIG. 6D illustrates the structure of FIG. 6B, with the rotatable cam shaft 441 rotated such that a second cam lobe 612 resides within detente 511 of spring 510. This action of the respective cam lobes 611, 612 dropping into detente 511 provides tactile feedback to the operator. For instance, the illustrated mechanical connect-assist mechanism advantageously provides a click or a vibration when the respective cam lobe drops within the detente during a seating or an unseating operation of the connector relative to the socket structure.

Figure 7A:
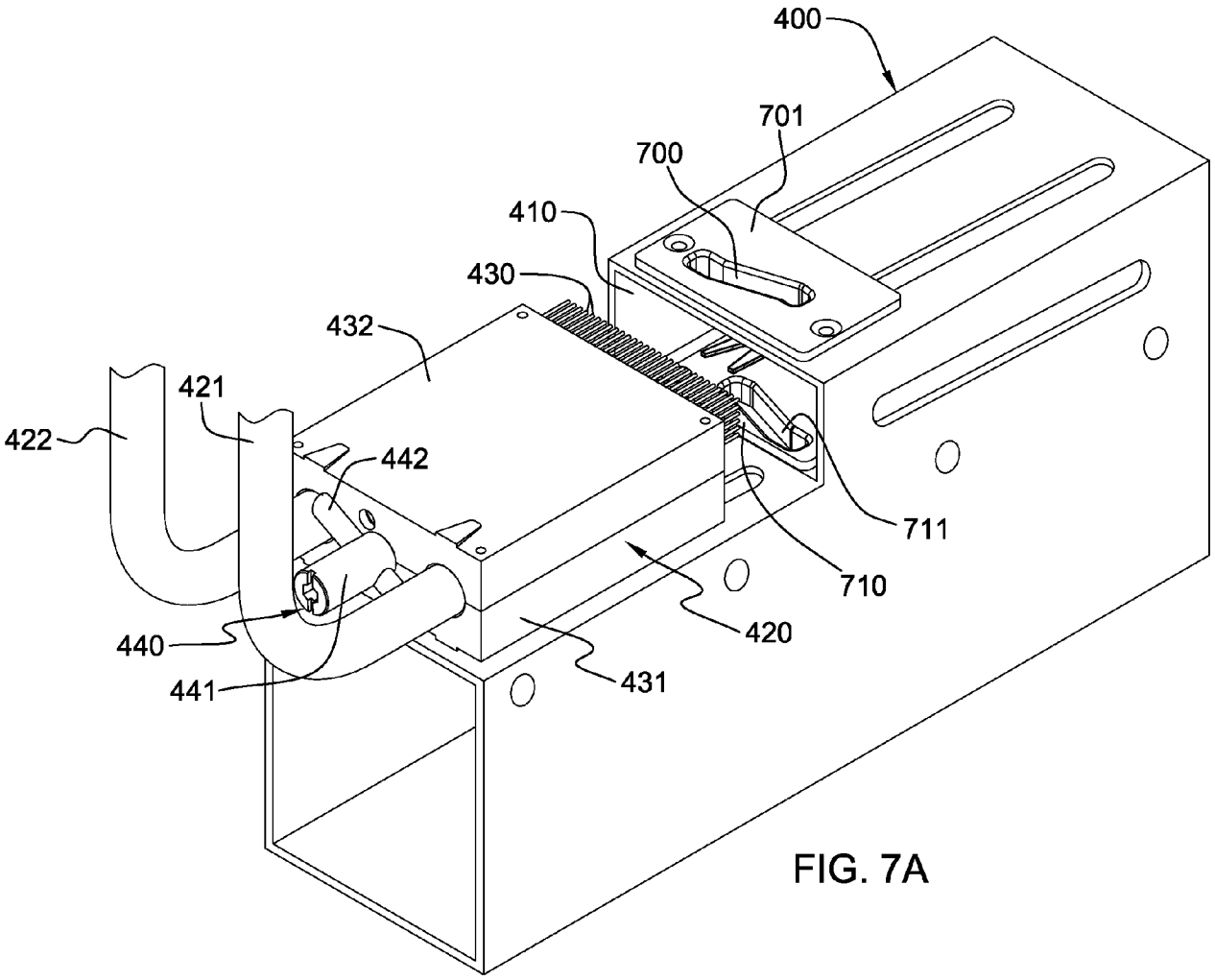
FIG. 7A is an inverted isometric view of the electronic assembly of FIG. 4, illustrating first and second element-receiving openings in the socket structure or housing associated with the socket structure within which the connect-assist element engages and moves with mechanical connect-assist seating of the cable connector within the socket structure, in accordance with one or more aspects of the present invention.
Figure 7C:
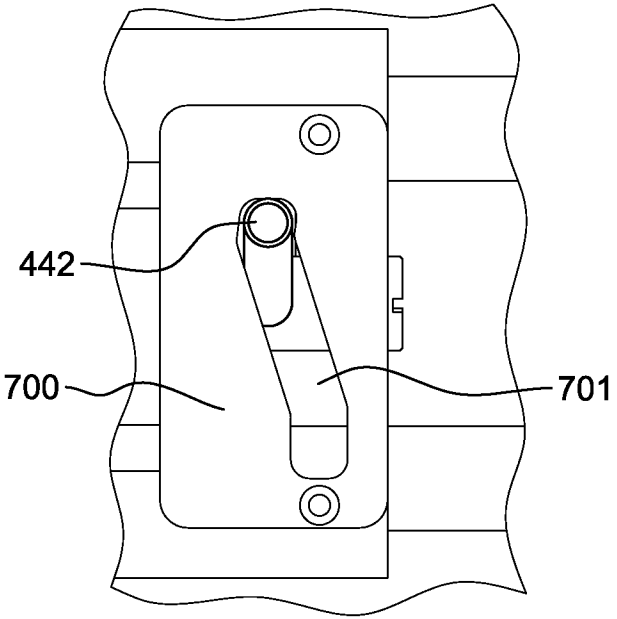
FIG. 7C depicts the connector apparatus of FIGS. 7A & 7B, with the connect-assist element shown moved within the connect-assist opening to a fully seated position of the cable connector within the socket structure, in accordance with one or more aspects of the present invention.
Figure 7B:
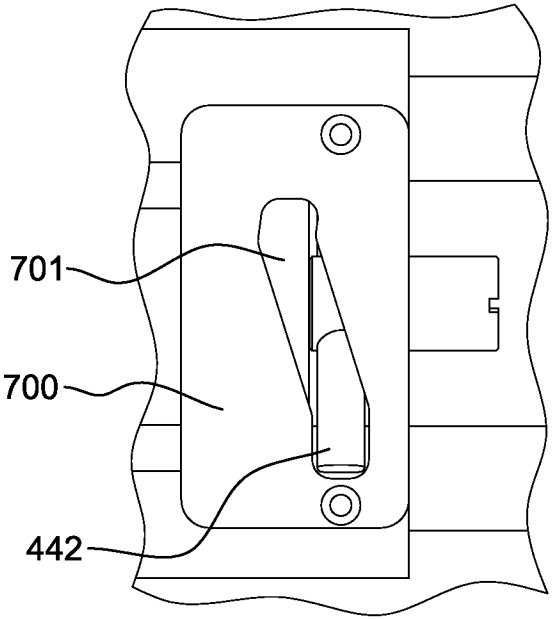
FIG. 7B partially depicts the connector apparatus of FIG. 7A, with the connect-assist element shown engaging the element-receiving opening with insertion of the cable connector into the socket structure at the start of connector plugging, in accordance with one or more aspects of the present invention.

FIGS. 7A-7C illustrate the caming action with insertion of connector 420 into socket structure 410 of the electronic assembly 400. As illustrated in FIG. 7A, in one embodiment, a first element-receiving opening 701 is provided in a first plate 700 and a second element-receiving opening 711 is provided in a second plate 710, which may comprise part of the socket structure 410 or part of a housing associated with the socket structure. These element-receiving openings 701, 711 are sized and configured to receive, in the embodiment depicted, connect-assist element 442 with insertion of the connector into the socket structure and rotation of the rotatable cam shaft as described herein.

In FIG. 7B, the connect-assist element 442 is shown engaging (by way of example) first element-receiving opening 701 of plate 700 with connector 420 (see FIG. 7A) inserted into the socket structure 410, but in an unseated position, that is, not fully docked or seated within the socket structure. In FIG. 7C, the rotatable cam shaft has been rotated to move the connect-assist element 442 within first element-receiving opening 701, and thereby to move the connector into a seated position relative to the socket structure. In the seated position, the connect-assist element 442 is shown moved to the opposite end of the elongate, first element-receiving opening 701. Note in this configuration of FIGS. 7A-7C that the first and second element-receiving openings 701, 711 are at least partially angled relative to an axis of insertion of connector 420 into socket structure 410, and as depicted in FIG. 7A, are mirror images of each other. This embodiment is particularly beneficial with a connect-assist element which projects in both directions from the rotatable cam shaft, such as with the use of a rod extending transverse through the rotatable cam shaft. Note that plates 700, 710 may be separate plates attached to the socket structure or associated housing, or may be integrally formed within the socket structure, which as defined herein, may include a portion of the associated housing.

Figure 8:
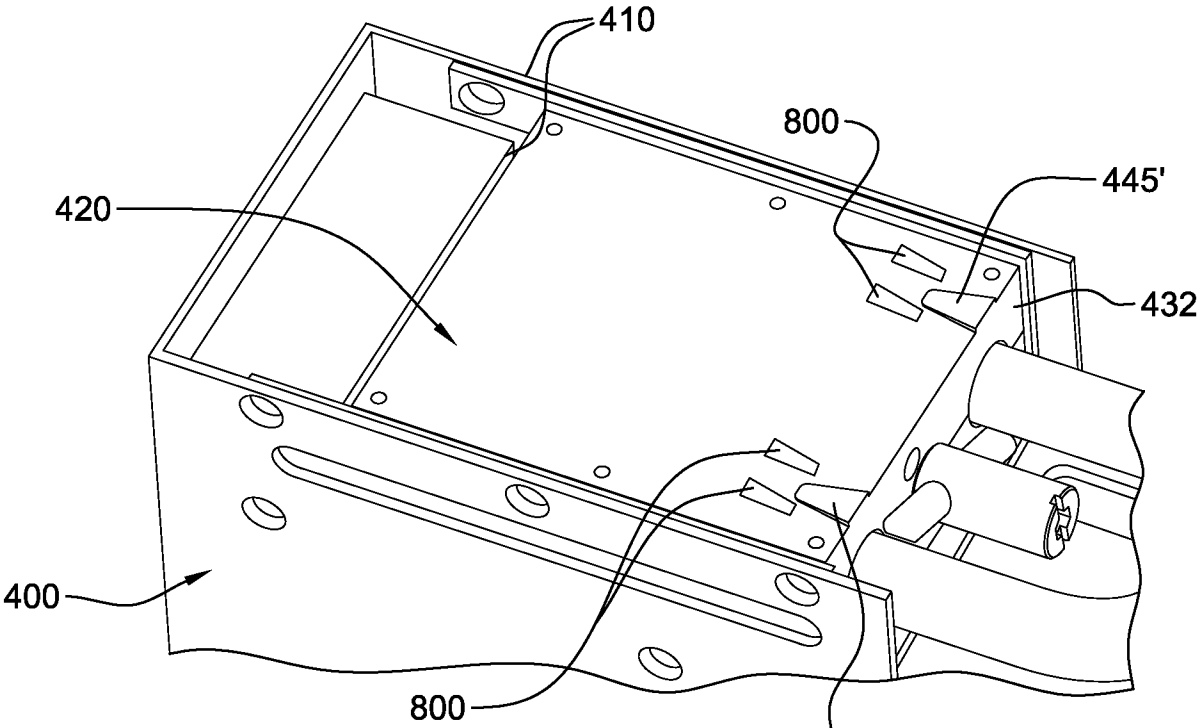
FIG. 8 is a partially cut-away view of the cable connector of FIGS. 4-7C in seated position within the socket structure, with a wall of the socket structure (or associated housing) removed to depict the tapered connector-supports on an outer surface of the connector enclosure, as well as a partial depiction of tapered supports of the socket structure which are configured to engage the tapered connector-supports of the connector enclosure with operative seating of the connector within the socket structure, in accordance with one or more aspects of the present invention.

FIG. 8 depicts connector 420 seated within socket structure 410 of electronic assembly 400, with a portion of the socket structure (or associated housing) removed to expose, in this embodiment, lower enclosure (or housing) 432 of connector 420, and in particular, a main surface of the lower enclosure 432. In this embodiment, multiple tapered connector-supports 445', such as illustrated and discussed above in connection with FIGS. 5A & 5B, are provided. In particular, these tapered connector supports 445' on the lower surface of the lower enclosure, and the tapered connector-supports 445 (see FIGS. 5A & 5B) on the upper surface of the upper enclosure, facilitate supporting connector 420 within the support structure (or associated housing), and relieve stress on the connector from the weight of the one or more cables attached to the connector. The tapered connector-supports, such as tapered connector-supports 445' of FIG. 8, engage respective walls of the socket structure to, for instance, facilitate retention of the connector in seated position within the socket structure. This function is facilitated by provision of one or more tapered supports 800 within the socket structure itself (e.g., on the portion or wall of the socket structure shown removed), sized and configured to engage or mate with the tapered connector-supports of the connector with seating of the connector within the socket structure. In one embodiment, the tapered connector-supports on the one or more outer surfaces of the connector and/or the tapered supports on one or more surfaces of the socket structure are tapered in both width and height to facilitate tight coupling of the connector within the socket structure or associated housing.

Those skilled in the art will note from the above discussion that provided herein is a connector apparatus which includes a mechanical connect-assist mechanism which facilitates a connector being plugged or seated fully within a socket. A connect-assist element, such as a rod, extends from the rotatable cam shaft and lie, for instance, perpendicular to the shaft so as to interface with element-receiving openings (or slots) in the socket structure or associated socket cage. As the cam shaft is rotated, the connect-assist element (or connect-assist elements) follow along the respective openings (or slots) and advance the connector to fully seat the connector within the socket structure. With seating of the connector within the socket structure, the tapered connector-supports of the connector and the tapered supports of the socket structure engage respective surfaces of the connector or socket structure to facilitate supporting the weight of the one or more cables attached to the connector. The mechanical connect-assist mechanism, including the connect-assist element and the associated element-receiving openings (or slots), prevent the cam shaft from rotating and unseating the connector if the one or more cables attached to the connector are inadvertently pulled. This function is further facilitated by providing a spring with a detente interacting with a respective cam lobe on the cam shaft. Note that the mechanical connect-assist mechanism disclosed herein is compact, and in one embodiment, is rotatable via a tool engaging a tool-receiving opening, such as a hex opening, at the free end of the rotatable cam shaft.

The mechanical connect-assist mechanism includes features which allow an operator to know if the connector is in proper position, prior to attempting to install the cable connector. Further, the connector has one or more visual indicators, such as differently colored dots on the rotatable cam shaft, which provide the operator with feedback on whether the connector is in unseated or seated position within the socket structure. Tactile feedback is provided via the spring and detente interacting with the respective lobe of the cam shaft, in either seated (latched or plugged) position or unseated (unlatched or unplugged) position.

Advantageously, the connector apparatus disclosed herein is a compact actuation mechanism which provides tactile response (or feedback), one or more visual indicator(s), and supports blind-access tool positioning where sight-line is impaired.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to explain the principles of the invention and the practical application, and to enable others of ordinary skill in the art to understand the invention through various embodiments and the various modifications thereto which are dependent on the particular use contemplated.

What is claimed is:

1. A connector apparatus comprising:

a connector configured to operatively plug into a socket structure; and a mechanical connect-assist mechanism associated, at least in part, with the connector, the mechanical connect-assist mechanism comprising:

a cam shaft rotatably coupled to the connector; and a connect-assist element projecting from the rotatable cam shaft, wherein the connect-assist element is configured to engage at least one element-receiving opening associated with the socket structure with insertion of the connector within the socket structure, and rotating of the rotatable cam shaft moves the connect-assist element within the at least one element-receiving opening to facilitate secure seating and retention of the connector within the socket structure.

2. The connector apparatus of claim 1, wherein the connect-assist element extends through the rotatable cam shaft is sized and configured to engage a first element-receiving opening associated with the socket structure and a second element-receiving opening associated with the socket structure, the first element-receiving opening and the second element-receiving opening being on opposite sides of the connector as the connector is inserted into the socket structure.

3. The connector apparatus of claim 2, wherein with insertion of the connector into the socket structure, rotating of the rotatable cam shaft moves the connect-assist element within the first element-receiving opening and within the second element-receiving opening, the first element-receiving opening and the second element-receiving opening being configured so that movement of the connect-assist element therein facilitates drawing the connector into a seated position within socket structure and retaining the connector in a seated position within the socket structure.

4. The connector apparatus of claim 3, wherein the connect-assist element comprises a rod extending through the rotatable cam shaft.

5. The connector apparatus of claim 4, wherein the rod extends transverse through the rotatable cam shaft.

6. The connector apparatus of claim 3, wherein the first element-receiving opening and the second element-receiving opening extend at an angle to an axis of insertion of the connector into the socket structure, and are mirror image openings.

7. The connector apparatus of claim 1, wherein the mechanical connect-assist mechanism further comprises at least one visual indicator, the at least one visual indicator indicating with insertion of the connector into the socket structure and rotating of the rotatable cam shaft one of connector-unseated or connector-seated within the socket structure.

8. The connector apparatus of claim 1, wherein the mechanical connect-assist mechanism further comprises a spring engaging the rotatable cam shaft and a detente in the spring configured to engage a cam lobe associated with the rotatable cam shaft, the cam lobe engaging, at least in part, the detente with seating of the connector within the socket structure to provide tactile feedback of connector seating within the socket structure.

9. The connector apparatus of claim 8, wherein the cam lobe comprises a first cam lobe associated with the rotatable cam shaft, and wherein the mechanical connect-assist mechanism further comprises a second cam lobe associated with the rotatable cam shaft, the second cam lobe engaging the detente with connector unseating from the socket structure to provide tactile feedback of unseating of the connector from the socket structure, wherein upon the second cam lobe engaging the detente, the connect-assist element has moved to an unseated position relative to the at least one element-receiving opening associated with the socket structure.

10. The connector apparatus of claim 1, wherein the connector comprises an enclosure, and the enclosure comprises tapered connector-supports on at least one outer surface thereof, the tapered connector-supports being configured to engage at least one surface associated with the socket structure with seating of the connector within the socket structure to facilitate retention of the connector in seated position within the socket structure.

11. The connector apparatus of claim 10, wherein the at least one surface associated with the socket structure includes tapered supports, the tapered supports associated with the socket structure and the tapered connector-supports of the enclosure engaging with seating of the connector within the socket structure to facilitate retention of the connector in seated position within the socket structure.

12. The connector apparatus of claim 1, wherein the connector is a cable connector, the cable connector being attached to at least one cable of an electronic system, and wherein the socket structure is associated with a housing, the housing comprising one or more electronic components of the electronic system.

13. An electronic assembly comprising:

an electronic system, the electronic system comprising:

a socket structure;

a connector apparatus, the connector apparatus comprising:

a connector configured to operatively plug into the socket structure of the electronic system:

a mechanical connect-assist mechanism associated with, at least in part, the connector, the mechanical connect-assist mechanism comprising:

a cam shaft rotatably coupled to the connector; and a connect-assist element projecting from the rotatable cam shaft, wherein the connect-assist element is configured to engage at least one element-receiving opening associated with the socket structure with insertion of the connector within the socket structure, and rotating of the rotatable cam shaft moves the connect-assist element within the at least one element-receiving opening to facilitate secure seating and retention of the connector within the socket structure.

14. The electronic assembly of claim 13, wherein the connect-assist element extends through the rotatable cam shaft is sized and configured to engage a first element-receiving opening associated with the socket structure and a second element-receiving opening associated with the socket structure, the first element-receiving opening and the second element-receiving opening being on opposite sides of the connector as the connector is inserted into the socket structure.

15. The electronic assembly of claim 14, wherein with insertion of the connector into the socket structure, rotating of the rotatable cam shaft moves the connect-assist element within the first element-receiving opening and within the second element-receiving opening, the first element-receiving opening and the second element-receiving opening being configured so that movement of the connect-assist element therein facilitates drawing the connector into a seated position within socket structure and retaining the connector in the seated position within the socket structure.

16. The electronic assembly of claim 15, wherein the connect-assist element comprises a rod extending through the rotatable cam shaft, and wherein the first element-receiving opening and the second element-receiving opening extend at an angle to an axis of insertion of the connector into the socket structure, and are mirror image openings.

17. The electronic assembly of claim 13, wherein the mechanical connect-assist mechanism further comprises a spring engaging the rotatable cam shaft and a detente in the spring configured to engage a cam lobe associated with the rotatable cam shaft, the cam lobe engaging, at least in part, the detente with seating of the connector within the socket structure to provide tactile feedback of connector seating within the socket structure.

18. The electronic assembly of claim 17, wherein the cam lobe comprises a first cam lobe associated with the rotatable cam shaft, and wherein the mechanical connect-assist mechanism further comprises a second cam lobe associated with the rotatable cam shaft, the second cam lobe engaging the detente with connector unseating from the socket structure to provide tactile feedback of unseating of the connector from the socket structure, wherein upon the second cam lobe engaging the detente, the connect-assist element has moved to an unseated position relative to the at least one element-receiving opening associated with the socket structure.

19. The electronic assembly of claim 13, wherein the connector is a cable connector, the cable connector being attached to at least one cable of the electronic system, and wherein the socket structure is associated with a housing of the electronic system, the housing comprising one or more electronic components of the electronic system.

20. A method of fabricating a connector apparatus, the method comprising:

providing a connector configured to operatively plug into a socket structure; and associating a mechanical connect-assist mechanism, at least in part, with the connector, the mechanical connect-assist mechanism comprising:

a cam shaft rotatably coupled to the connector; and a connect-assist element projecting from the rotatable cam shaft, wherein the connect-assist element is configured to engage at least one element-receiving opening associated with the socket structure with insertion of the connector within the socket structure, and rotating of the rotatable cam shaft moves the connect-assist element within the at least one element-receiving opening to facilitate secure seating and retention of the connector within the socket structure.

* * * * *